United States Patent [19]

Huebner et al.

[11] 3,937,648

[45] Feb. 10, 1976

[54] METHOD OF MAKING PAPER HAVING A HIGH RESIN FILL

[75] Inventors: Klaus Huebner, Ober-Ramstadt-Eiche; Helmut Neumann, Goddelau; Hans Ottofrickenstein, Darmstadt-Eberstadt; Helmut Moroff, Trautheim; Norbert Suetterlin, Greisheim, all of Germany

[73] Assignee: Röhm GmbH, Darmstadt, Germany

[22] Filed: June 15, 1973

[21] Appl. No.: 370,239

[30] Foreign Application Priority Data

June 24, 1972 Germany ..... 2230985

[52] U.S. Cl. ..... 162/168 R; 162/169; 162/179

[51] Int. Cl.[2] ..... D21D 3/00

[58] Field of Search ..... 162/179, 168, 169, 183, 162/164; 260/29.6 TA

[56] References Cited

UNITED STATES PATENTS

| | | | |
|---|---|---|---|
| 2,769,711 | 11/1956 | Wilson | 162/168 |
| 3,043,822 | 7/1962 | Maeder | 260/80.3 N |
| 3,174,874 | 3/1965 | Fikentscher et al. | 162/168 |
| 3,262,985 | 7/1966 | Muller et al. | 260/80.73 |
| 3,759,861 | 9/1973 | Shimokawa | 260/29.6 TA |

*Primary Examiner*—Robert L. Lindsay, Jr.
*Assistant Examiner*—Peter Chin
*Attorney, Agent, or Firm*—Curtis, Morris & Safford

[57] ABSTRACT

Method for making highly resin-filled paper on a paper machine employing a fiber slurry having therein a non-ionic resin in an amount of at least 30 percent (dry resin weight based on dry fiber weight), said resin being combined with the fiber slurry as a dispersion comprising a cationic and a non-ionic dispersing agent.

2 Claims, No Drawings

METHOD OF MAKING PAPER HAVING A HIGH RESIN FILL

The present invention relates to a method for making paper having a high resin fill from an aqueous fiber suspension.

It is known in the art to use dispersions of synthetic resins in the preparation of papers. However, the anionic and non-ionic resin dispersions most commonly used in industry are only of limited suitability for this purpose, since the resin particles therein do not bind with the fibers in a paper pulp and, for the large part, are separated with the water during sheet formation. Pre-treatment of the fibers or precipitation of the dispersions in the paper pulp cannot completely overcome these disadvantages.

Cationic resin dispersions, in contrast, are easily absorbed onto fiber material without the use of auxiliary agents, a phenomenon which is attributable to the negative charge developed on fiber surfaces in a paper pulp. For this reason, cationic dispersions are employed as binders in the preparation of paper. For sizing, the amount of binder employed is from 0.5 – 5 percent, calculated using the dry weights of the resin and of the fiber material. For the preparation of waterproof papers, up to 15 or 20 percent by weight of resin can be used in extreme cases. These values represent the most extreme limit for resin additions in the preparation of raw papers.

For the preparation of laminates, special papers which contain between 20 and 100 percent of resin by weight of the fiber material are required. These materials have only a limited resemblance to paper in the conventional sense: for example, they are generally airtight and watertight and assume a resin-like character as the amount of resin filler therein increases. Special papers of this type are practically exclusively prepared from absorbent raw paper by saturating the latter with a resin dispersion in a separate process step and then drying with an application of heat. This process can be carried out at only a fraction of the speed of operation with which paper can be prepared on paper machines. For this reason, highly filled papers are relatively expensive.

It has been attempted in the art to produce papers of this type directly on a paper machine using cationic resin dispersions. Such a process is not successful if cationic dispersions which are suitable for the preparation of weakly filled papers are used. The cationic dispersions have a low degree of stability and tend to coagulate when they are incorporated into a paper slurry in large amounts. Papers having a non-uniform distribution of the resin are obtained.

If the stability of the resin dispersion is raised by increasing the amount of cationic emulsifier therein, the resin is absorbed rapidly and completely up to a certain degree of fill. However, at a greater degree of fill, the resin is no longer completely bound to the fiber material and migrates to the paper surface on drying. This defect can be explained by postulating that the negative charge of the fiber surface becomes saturated by the cationic emulsifier, or even that there is a charge reversal, so that the resin particles not yet absorbed are rejected.

According to German Auslegeschrift (DAS) No. 1,209,867, this disadvantage is avoided by adding to the pulp, after the cationic dispersion, either a further anionic resin or an anionic dispersion which precipitates those cationically dispersed particles which are not yet bound to the fibers. In the alternative, the fiber suspension is treated with an anionic resin before the addition of the cationic dispersion, in this way increasing the amount of anionic charges in the pulp. This process has the disadvantages that several stages are necessary in the treatment of the paper pulp and that, in addition to the coating of the fibers with resin, a certain amount of coagulate formation always occurs which leads to an inhomogeneous distribution of the resin in the paper.

A further process for the preparation of highlyfilled papers on a paper machine is taught in DAS No. 1,446,609. Here, cationic dispersions are also used, but a large fraction of the cationic charges is supplied by the resin itself. The polymers employed contain side chains with quaternary ammonium groups, particularly units of N-vinyl-N′-methyl-imidazolium methosulfate. The monomer containing such units is expensive and the preparation of such dispersions is not without problems. For this reason, the process has not been adopted in practice. Further, in this case also there can be a saturation of the negative charges of the fiber materials, as a result of which there is a decrease in the affinity between the fiber and the resin.

The attempts made so far to prepare papers containing more than 20 percent by weight of resin (calculated on the dry fiber weight) using cationic dispersions proceed from the basic concept of increasing the cationic character of the dispersion as much as possible and of embodying this character in the resin itself, rather than in an emulsifier, in order on the one hand to make the dispersions more stable and, on the other hand, to increase the affinity of the resin particles for the fiber surface.

The present invention is based on the recognition that this basic concept is not successful if the cationic charges of the resin considerably exceed the anionic charges of the fiber surface. This situation arises if a strongly cationic resin is added in large amounts.

It has now been found that even a large amount of resin can easily and completely be absorbed on a fiber material if (1) the dispersion is stabilized with a non-ionic dispersing agent, so that its cationic character can be kept relatively weak, and also (2) if a non-ionic resin is employed. The latter negates any need for special cationic comonomers.

It has further been found that the resin is better absorbed on fibers the more hydrophobic the resin is.

More in particular, the present invention teaches a process for the preparation of papers with a high degree of resin fill from aqueous fiber slurries and cationic resin dispersions in which a resin dispersion is combined with a fiber slurry in an amount of at least 30 percent, calculated using the dry weight of the resin and the weight of the dry fiber. The resin dispersion contains a dispersed non-ionic resin as well as cationic and non-ionic dispersing agents. The resulting mass is then worked up into paper in conventional fashion.

By the term "non-ionic resin" is to be understood those synthetic resins which completely comprise neutral monomers, usually vinyl or vinylidene monomers, forming salts neither in aqueous alkaline nor in aqueous acid media. Monomers of this type include, for example, the hydrocarbon, preferably alkyl, esters of acrylic acid and methacrylic acid such as methyl-, ethyl-, butyl-, or 2-ethylhexyl-acrylate, methyl-, ethyl-, butyl-, hexyl-, or decyl-methacrylate; vinyl esters of alkanoic acids such as vinyl acetate or vinyl propionate; vinyl chloride; vinylidene chloride; acrylonitrile and methacrylonitrile; styrene and its homologs; butadiene; chlorobutadiene; isoprene; ethylene; propylene, or mixtures of these monomers. Preferably, such esters of acrylic acid and/or methacrylic acid and/or styrene and/or vinylidene chloride comprise the major portion of the resin, i.e., at least 70 percent by weight.

In many cases, particular advantages can be obtained if the resin also contains groups capable of thermal cross-linking. Such groups are introduced, for example, by units of methylolacrylamide or methylolmethacrylamide or their ethers, which units optionally may be present with units of acrylamide or methacrylamide and units of hydroxylalkyl esters of acrylic acid or methacrylic acid. Methylolacrylamide or methylolmethacrylamide are present in an amount from 0.2 to 12 percent, preferably 1 to 6 percent, by weight of the dispersed resin in these dispersions. The corresponding ethers, for example methoxymethyl acrylamide or butoxymethyl methacrylamide can be incorporated in the same amounts into the resin. The latter, however, are less preferred since they require a higher cross-linking temperature.

Monomers contributing hydrophobicity to the resin increase the fiber affinity of the resin and for this reason are incorporated in the greatest possible amount. Nevertheless, this amount is limited for the most part because some of these monomers also act as plasticizers, which is not always desirable. Monomers imparting hydrophobicity are all those which contain aromatic side groups or aliphatic side groups containing at least four carbon atoms. Exemplary materials are the butyl-, hexyl-, decyl-, and dodecyl-esters of acrylic acid or methacrylic acid, the vinyl esters of butyric acid or higher fatty acids, and styrene and its homologs.

Processes for the preparation of cationic dispersions are known in the art and need not be discussed here in detail. The cationic dispersing agent, for example a $C_{12}$–$C_{14}$-fatty amine hydrochloride, coconut amine hydrochloride, or cetyl trimethyl ammonium chloride, is, in the present invention, added at the beginning of the polymerization, whereas the non-ionic dispersing agent also present in the finished dispersion is added only after polymerization is concluded. Compounds having surface activity are preferably employed as non-ionic dispersing agents, for example oxyethylated fatty acids, oxyethylated fatty alcohols, or oxyethylated alkylphenols. However, protective colloids such as polyvinyl alcohol, polyacrylamide, polyvinyl pyrrolidone, and polyalkylene oxides can be used, as can block copolymers of ethylene oxide and propylene oxide.

According to its efficacy, the cationic emulsifier is suitably present in an amount of from 0.5 – 2.5 percent by weight of the aqueous phase: the non-ionic emulsifier is usually used in an amount of from 1 – 4 percent, on the same basis. However, these amounts can be exceeded in particular cases.

Polymerization is initiated by conventional free radical forming initiators. Preferably, such initiators are employed which do not introduce anionic groups into the polymer. That is, hydrogen peroxide or azo-bis isobutyronitrile are more suitable than are potassium persulfate or ammonium persulfate or azo-bis-cyanovalerionic acid and the like.

In order to reduce shipping weight and storage volume, the dispersions are prepared in concentrations of from 30 – 60 percent by weight although, as a rule, they are used in very much greater dilution.

In these dispersions, the resin particles have an average particle size ranging from about 0.01 to about 1 μm.

The preparation of the resin-filled paper follows conventional paper machine processes. A fiber slurry is employed which, in most cases. comprises wood pulp or other shortfibered, natural cellulosic fibers, for example beaten cotton fibers. However, mixtures comprising at least 30 percent by weight of such fibers can also be employed, the balance being synthetic cellulose fibers, mineral fibers, other synthetic fibers, or mixtures thereof. Fiber slurries which contain less than 30 percent of natural cellulosic fibers, or which contain no such fibers, may produce papers whose resin content is not fully satisfactory.

Finally, conventional fillers such as kaolin or titanium dioxide may be present in the fiber slurry.

The cationic dispersions of resin are suitably added at the machine box after beating to a stock density from 2 – 5 percent. The dispersions are added in such an amount that at least 30 parts by weight of resin are present for each 100 parts by dry weight of the fiber material.

For the preparation of decorative papers, from which decorative laminates for the furniture and construction industries are prepared, considerably higher resin contents, for example from 60 to 100 parts by weight of resin for each 100 parts by weight of fiber, are often necessary. Additionally, small amounts of water-soluble urea-formaldehyde resins or similar condensation resins can be added.

After combination of the resin dispersion with the stock-water mixture, the dispersion particles are absorbed on the fiber surfaces. This process is as a rule concluded after a mixing time of from 20 – 40 minutes. In case it is necessary, the pH value of the aqueous phase can be adjusted at this stage, for example with aluminum sulfate.

For processing on a paper machine, the stock mixture is then diluted with water to a stock density of, for example, 0.5 – 1 percent, according to the requirements of the machine. Sheet formation follows in the usual manner on a fourdrinier that, in known fashion, runs at a speed of from 50 – 250 meters per minute over a number of table rolls, suction boxes, and a suction roll. However, cylinder machines can also be used.

The water flowing off from the paper machine is, in the normal case, completely clear or free of binder fractions. However, turbidity can occur from the presence of pigment particles or filler particles. In the preparation of papers containing a high fraction of synthetic fibers, a loss of binder can also occur at times.

In case a dispersion of a thermoplastic resin is employed, the paper train after leaving the wire runs over several wet presses into a drying section operating at 90°–120°C. for festoon drying on poles moved by a chain conveyor. If a self-cross-linking dispersion has been employed, the paper train, after wet pressing, passes over several drying cylinders, which should have a temperature of 120° – 150°C., for hardening the resin. The residual moisture can be from 3 to 5 percent. The finished papers, which in general have a surface density of from 70 – 400 grams per square meter can be soft and pliable, elastically flexible, or hard and brittle depending on the composition of the resin employed and the degree of filling.

The paper can be uniformly colored by stock dyeing or by dip dyeing at the size press. If the paper is to be printed, a pre-calendering is recommended at 60° – 120°C. on a calender having from 6 – 12 passages between steel and paper rolls. Aqueous printing inks are mainly employed for printing. Subsequently, the paper is often embossed at 120° – 150°C. The colored or printed paper is usually also provided with a final coating, primarily for protection of the pattern.

Decorated papers prepared according to the present invention are used for the preparation of composite sheets for furniture manufacture or interior decoration by adhesion to fiberboard or chipboard sheets. It can be advantageous to introduce a polished intermediate layer between the carrier sheet and the decorative paper sheet.

The process of the present invention represents a significant step forward in comparison with the process heretofore used in practice in which a paper is first prepared on a paper machine and then filled with resin in a second stage. According to the invention, the two stages are combined into a single process. The process of the invention is also free of the disadvantages which are characteristics of the attempts heretofore made to prepare highly resin-filled papers on a paper machine. The complete retention of the resin on the fibers is also of considerable significance from the standpoint of the treatment of waste water, since the removal of unadsorbed resin latex particles from the waste water is a difficult problem.

A better understanding of the present invention and of its many advantages will be had by referring to the following specific examples, given by way of illustration.

EXAMPLE 1

Part A — Preparation of the Dispersion

An aqueous emulsion of a monomer mixture comprising 54 parts by weight of methyl methacrylate, 44 parts by weight of n-butyl acrylate, and 2 parts by weight of N-hydroxymethyl methacrylamide, which contains 0.18 part by weight of 30 percent hydrogen peroxide and 0.95 part by weight of cetyl trimethyl ammonium chloride, is added continuously over a period of 4 to 6 hours at 85°C. to an aqueous solution of 0.05 part by weight of cetyl trimethyl ammonium chloride, 0.005 part by weight of iron (II) chloride, and 0.02 part by weight of 30 percent hydrogen peroxide. After conclusion of the polymerization, the dispersion is stabilized with 4 parts by weight of an adduct of isononyl phenol and 100 mols of ethylene oxide. A coagulate-free dispersion containing 50 percent of solids is obtained.

Part B — Preparation of a Decorative Paper 270 kg of bleached air-dried sulfite pulp (pine), 270 kg of bleached air-dried sulfite pulp (birch), and 100 kg of titanium dioxide (rutile R 4/61) are beaten in a Hollander beater at a stock density of 4 percent (dry weight) to a freeness of 35° (Schopper-Riegler).

400 kg of the 50 percent dispersion prepared in part (A) are added to the pulp-water mixture in the machine box, which corresponds to a resin content of 44.5 percent, by weight of the dry cellulose. After 30 minutes' mixing, the pH value is adjusted to 5.4 with aluminum sulfate and 10 kg of urea formaldehyde resin ("Urecoll") are added.

The mixture is diluted to a stock density of 0.7 percent and introduced onto a fourdrinier having a screen velocity of about 100 meters per minute. The paper train runs through a drying apparatus whose temperature rises from 90° – 120°C. and then drops again to 90°C. A paper having a residual density of about 4 percent and a surface density of 180 g/m² is obtained. After calendering at 60°–120°C., the paper can be printed.

EXAMPLE 2

Part A — Preparation of the Dispersion

An aqueous emulsion comprising 45 parts by weight of methylmethacrylate, 7 parts by weight of styrene, 48 parts by weight of n-butylacrylate, and containing 0.18 part by weight of 30 percent hydrogen peroxide and 0.95 part by weight of $C_{14}$-fatty amine hydrochloride dissolved therein, is added dropwise at 85°C. over a period of 4 – 6 hours to an aqueous solution comprising 0.05 part by weight of $C_{14}$-fatty amine hydrochloride, 0.005 part by weight of iron (II) chloride, and 0.02 part by weight of 30 percent hydrogen peroxide. The dispersion obtained is subsequently combined with 4 parts by weight of an adduct formed between isononyl phenol and 100 mols of ethylene oxide. A coagulate-free dispersion having a solids content of about 50 percent is obtained.

Part B — Paper Preparation 60 kg of cotton, 25 kg of wood pulp, 15 kg of nylon (staple length = 6 mm; 2.2 dtex), 15 kg of titanium dioxide (rutile), and 5 kg of china clay V are beaten to a freeness of 50° SR in a Hollander beater at a pH value of the aqueous phase of 5.6 and a stock density of 3 percent.

In the machine box, 80 kg of the 50 percent dispersion prepared in part (A) and 100 grams of a defoaming agent ("Nopco NXZ") are combined. The stock-water mixture is diluted to a stock density of 0.05 percent when leaving the box. Sheet formation follows at a machine velocity of about 50 meters per minute on a cylinder machine.

The paper train taken from the cylinder runs over pressing rolls into a drying arrangement operating at about 90°C. with a rod transport mechanism (festoon drying), and proceeds from there to smoothing apparatus having two heated steel rolls. The paper so prepared has a surface density of about 100 grams/m² and a resin content which is about 25 percent of the total paper weight.

Similar results are obtained when lauryl pyridinium chloride, trimethyl carboxymethyl cetylammonium chloride, or dimethyl stearyl benzylammonium chloride are used instead of the $C_{14}$-alkyl-fatty amine hydrochloride as cationic dispersing agent or when lauryl polyglycol ether, stearic acid amide-N-polyglycol ether, or stearic acid polyglycol ester are used instead of the isononyl phenol polyglycol ether as non-ionic dispersing agent in the preparation of the dispersion.

What is claimed is:

1. In the method of making a resin-filled paper on a paper machine from an aqueous fiber slurry having a resin filler dispersed therein, said resin-filled paper having a resin content of from 20 to 100 percent, based on the weight of the fibers therein, the improvement which comprises employing, as the aqueous resin-filled fiber slurry, a slurry comprising A. 100 parts by weight of fibers comprising at least 30 percent by weight of natural cellulosic fibers;

B. an aqueous dispersion of a non-ionic synthetic thermoplastic resin free of groups capable of thermal cross-linking and completely comprising neutral vinyl or vinylidene monomers which form salts neither in aqueous alkaline media nor in aqueous acid media, said dispersion comprising from 0.5 to 2.5 percent, by weight of the aqueous phase of said dispersion, of a cationic dispersing agent, and from 1 to 4 percent, by weight of the aqueous phase of said dispersion, of a non-ionic dispersing agent, the dry weight of resin in said dispersion being from 30 to 100 parts; and

C. an amount of water such that the fiber content of the fiber slurry is between 0.5 and 1 percent.

2. A method as in claim 1 wherein said non-ionic resin comprises a major portion of at least one member selected from the group consisting of acrylic acid esters, methacrylic acid esters, and styrene.

* * * * *